United States Patent [19]

Sims et al.

[11] 4,059,917

[45] Nov. 29, 1977

[54] SIMULATED FIRECRACKER

[75] Inventors: Larry Averett Sims, Hermosa Beach; William John Kelley, Torrance, both of Calif.

[73] Assignee: Mattel, Inc., Hawthorne, Calif.

[21] Appl. No.: 740,506

[22] Filed: Nov. 10, 1976

[51] Int. Cl.[2] ..... A63H 5/00

[52] U.S. Cl. ..... 46/196; 46/176; 46/177; 124/2

[58] Field of Search ..... 46/175 R, 177, 176, 46/196, 200; 124/2

[56] References Cited

U.S. PATENT DOCUMENTS

| | | | |
|---|---|---|---|
| 846,884 | 3/1907 | Wilkinson et al. | 46/200 |
| 1,017,683 | 2/1912 | Meis | 46/200 |
| 1,246,315 | 11/1917 | Peal | 46/176 |
| 1,367,391 | 2/1921 | Hofer | 46/200 |
| 1,662,971 | 3/1928 | Howe | 46/199 |
| 1,663,679 | 3/1928 | Carpenter | 46/176 |
| 2,033,105 | 3/1936 | Cowles | 46/196 |
| 2,710,490 | 6/1955 | Wildstein | 46/200 |
| 3,139,697 | 7/1964 | Mier | 46/196 |
| 3,225,490 | 12/1965 | Ostrom | 46/200 |
| 3,277,603 | 10/1966 | Ryan | 46/196 |
| 3,407,532 | 10/1968 | Ryan et al. | 46/176 |

*Primary Examiner*—Louis G. Mancene
*Assistant Examiner*—Robert F. Cutting
*Attorney, Agent, or Firm*—Max E. Shirk; Stephen L. King; John M. May

[57] ABSTRACT

A noisemaking toy, more particularly, a simulated firecracker is presented which includes an elongate hollow cylindrical body and an elongated cord extending from one end; a piston assembly located within the body attached to the cord; a compression spring is provided for driving the piston; and a cap detonating assembly is located at the remote end of the body, the assembly containing a trigger mechanism which extends within the cylinder in the path of travel of the piston; and a sound generating means for emitting a whistle is coupled to the piston; whereby withdrawal of the cord to retract the piston and compress the spring, followed by release of the cord, allows the piston to travel forward along the axis of the body at a controlled rate, providing a whistling sound for a predetermined interval of time followed by the actuation of the cap detonating means.

11 Claims, 8 Drawing Figures

1
1
3
1
2
7
5
6

5
5
4
4
3
3
1
2
7
5
9
10
11
12
12
13
14
18
19
20
22
23
24
25
26
28
29
32
33
34
35
36
37
38
3

1
9
17
14
11
15
18
12
13
19
26
3
27
20
21
22
23
24
25

11
10
45
41
43
19
39
13
14
12
1

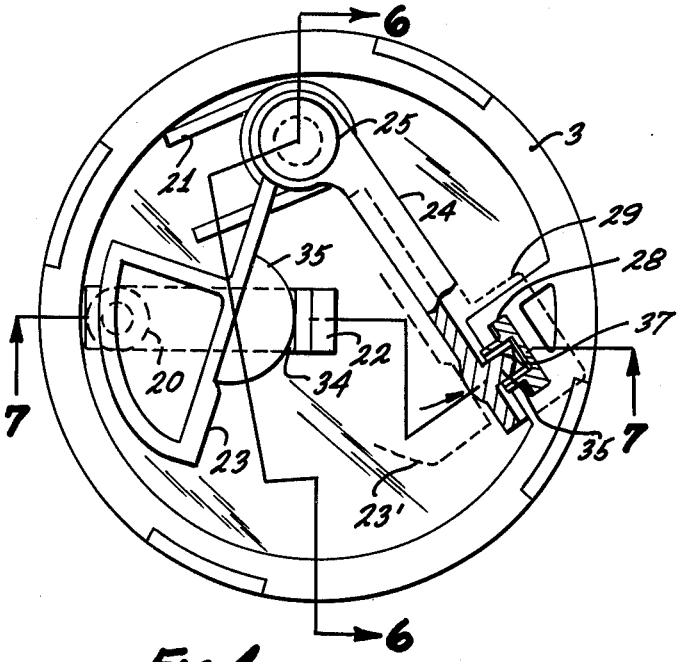
FIG. 4
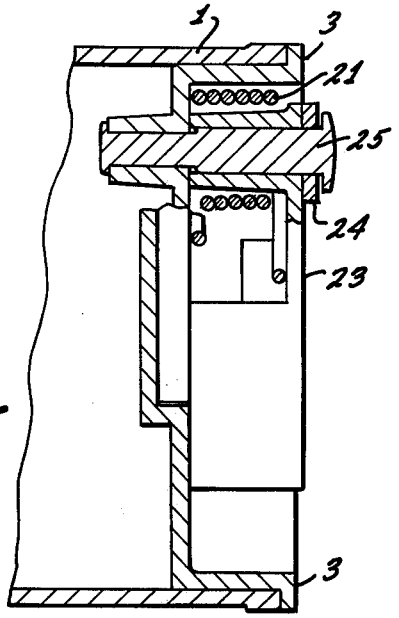
FIG. 5
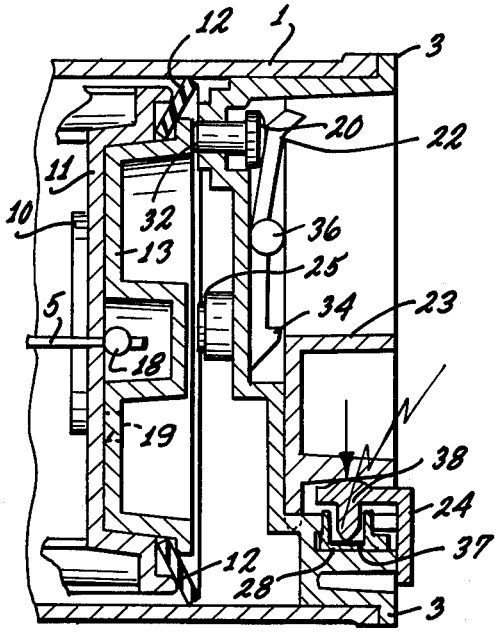
FIG. 6
FIG. 7
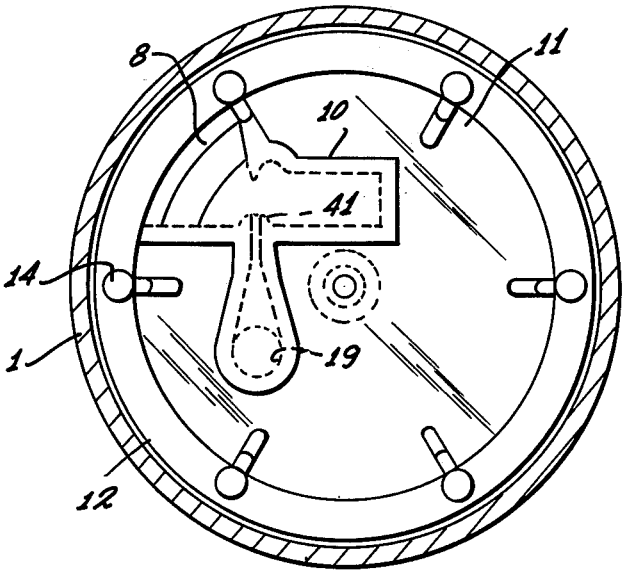

SIMULATED FIRECRACKER

BACKGROUND OF THE INVENTION

The present invention relates to noisemaking toys and, in particular, to a simulated firecracker for detonating the well-known percussion cap.

The stock of children's toys usually contains one or more toys of the noisemaking type. Of these, the most familiar are the whistle and the conventional cap-detonating toys, such as the familiar cap gun or torpedo. By way of background, prior art patents which have been made known to the inventors, illustrative of prior art cap exploding mechanisms with which the present invention is related, include U.S. Pat. No. 2,710,490, "Toy Torpedo or Bomb", U.S. Pat. No. 2,033,105, U.S. Pat. No. 1,662,971, U.S. Pat. No. 1,017,683, U.S. Pat. No. 846,884, appear representative, and U.S. 1,367,391 and U.S. 3,225,490 illustrate and disclose cap-detonating mechanisms decorated to simulate a conventional hand grenade.

Returning to the prior art patent of Ostrom, U.S. Pat. No. 3,225,490, by way of background to the present invention, a cap-detonating mechanism in the form of a simulated hand grenade, an anti-personnel explosive used by the Armed Forces, is illustrated. The cap-detonating mechanism there shown includes an anvil on which to place a percussion cap, a spring-loaded plunger-hammer mechanism, which functions as the cap detonating hammer, in which withdrawal and release of the plunger allows the spring to drive the plunger-hammer into the cap with the resulting explosion. Further, Ostrom discloses a cord means with which to withdraw the plunger to its retracted position and a pin to fixedly secure said cord, hence the plunger, in the retracted position until it is to be released to detonate the cap. Ostrom further discloses a means to initially slow the forward movement of the plunger-hammer once it is released for a short interval to provide a time delay before detonation occurs, as in the case of an actual hand grenade, and this is accomplished by means of a spring which grasps the cord as it moves forward with the plunger-hammer for a predetermined axial distance.

As is also known to the reader, there have existed a class of explosives formerly handled by children and now almost universally outlawed, known as firecrackers and like explosives. While the firecracker explosive poses an obvious danger to children, the thrill of handling a device thought to be dangerous perhaps provides some of the excitement that occupied the child and was reason enough for it to persist in being accepted.

As an object of the present invention, the present invention provides a detonating toy of improved construction which simulates a firecracker or other type of explosive without the degree of danger of injury. A further object of the invention is to provide a novel and improved means in a cap-detonating toy to provide a time delay between actuation and the actual detonation of the cap and additional sounds during the delay period. It is a still further object of the invention to provide a simulated toy firecracker which is of a simple, relatively uncomplicated and easy to manufacture construction.

SUMMARY OF THE INVENTION

The present invention in a cap-detonating toy is characterized by an elongate hollow cylinder closed at each end, with one of the ends containing a small opening through which an elongate retractable cord or string, simulating a fuse, extends, and in which the cylinder supports both a sound-generating means for emitting a whistle-like sound and further supports a cap-detonating means for detonating a percussive cap. Means are provided within the cylinder which is responsive to the withdrawal and subsequent release of the cord to actuate the sound generating means, which provides a whistling sound for a predetermined interval or delay period, followed by actuation of the cap-detonating means, which explodes an installed percussive cap. In a specific aspect of the invention, the whistle means includes a resonator coupled edge tone generator formed of passages in a piston movable within the cylinder and in which the piston is driven by a helical compression spring. The cylinder and piston assembly form a pneumatic tube in which forward axial movement of the piston under the driving force of the expanding spring, produces a pressure buildup within the cylinder that is slowly released through the whistle to create the sound over a predetermined interval of time as the piston moves forward. In accordance with a further aspect of the invention, the end of the tube includes, sealed thereto in an airtight relationship, the cap-detonating mechanism, which contains a means for holding the cap, and a trigger mechanism therefor which extends axially within the inside of the cylinder in the path of travel of the piston.

The foregoing objects and advantages of the invention as well as the detailed structure characteristic of the invention is better understood by making reference to the detailed description of a preferred embodiment, which follows, taken together with the illustrations thereof presented in the figures of the drawings.

BRIEF DESCRIPTION OF DRAWINGS

In the drawings:

FIG. 4 is an end view taken along the lines 5—5 of FIG. 3;

FIG. 5 is a partial cross-section view taken along the lines 6—6 in FIG. 4 as modified;

FIG. 6 is a partial section of FIG. 4 taken along the lines 7—7 in FIG. 4 as modified;

FIG. 7 is a cross-section taken along the lines 3—3 in FIG. 3;

DESCRIPTION OF THE PREFERRED EMBODIMENTS

Figure 1:
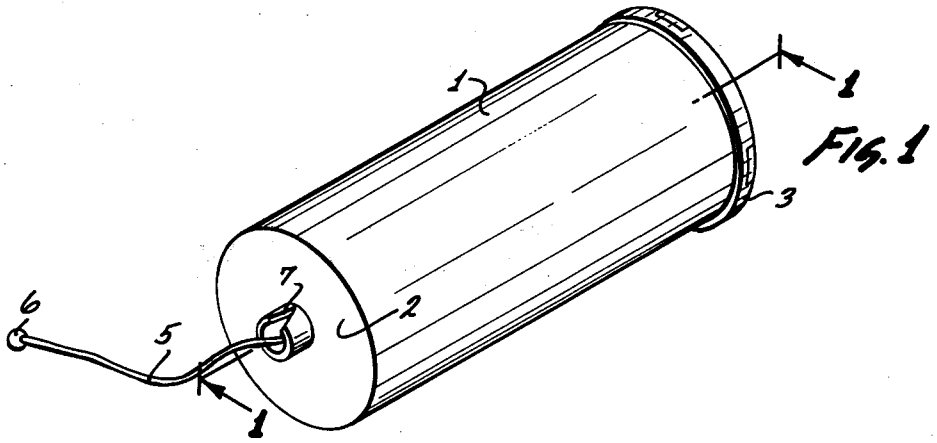
FIG. 1 is a perspective illustration to reduced scale of a preferred embodiment of the invention.

The appearance of the simulated firecracker, as is illustrated in perspective in FIG. 1, is an elongate cylinder 1, constructed for example of plastic or metal. The cylinder has one end closed by a wall 2 and the other end closed by a member 3, the latter which is not fully illustrated in this figure. The outer cylindrical wall may contain any suitable decoration. A cord 5, suitably having a small bead 6 attached at an end to assist in gripping, extends through a small opening in back wall 2 to within the inside of cylinder 1 and simulates a firecracker's fuse. An axially protruding hollow cylinder 7 having an axially extending V-shaped notch is formed about the opening in wall 2.

Figures 2, 8:
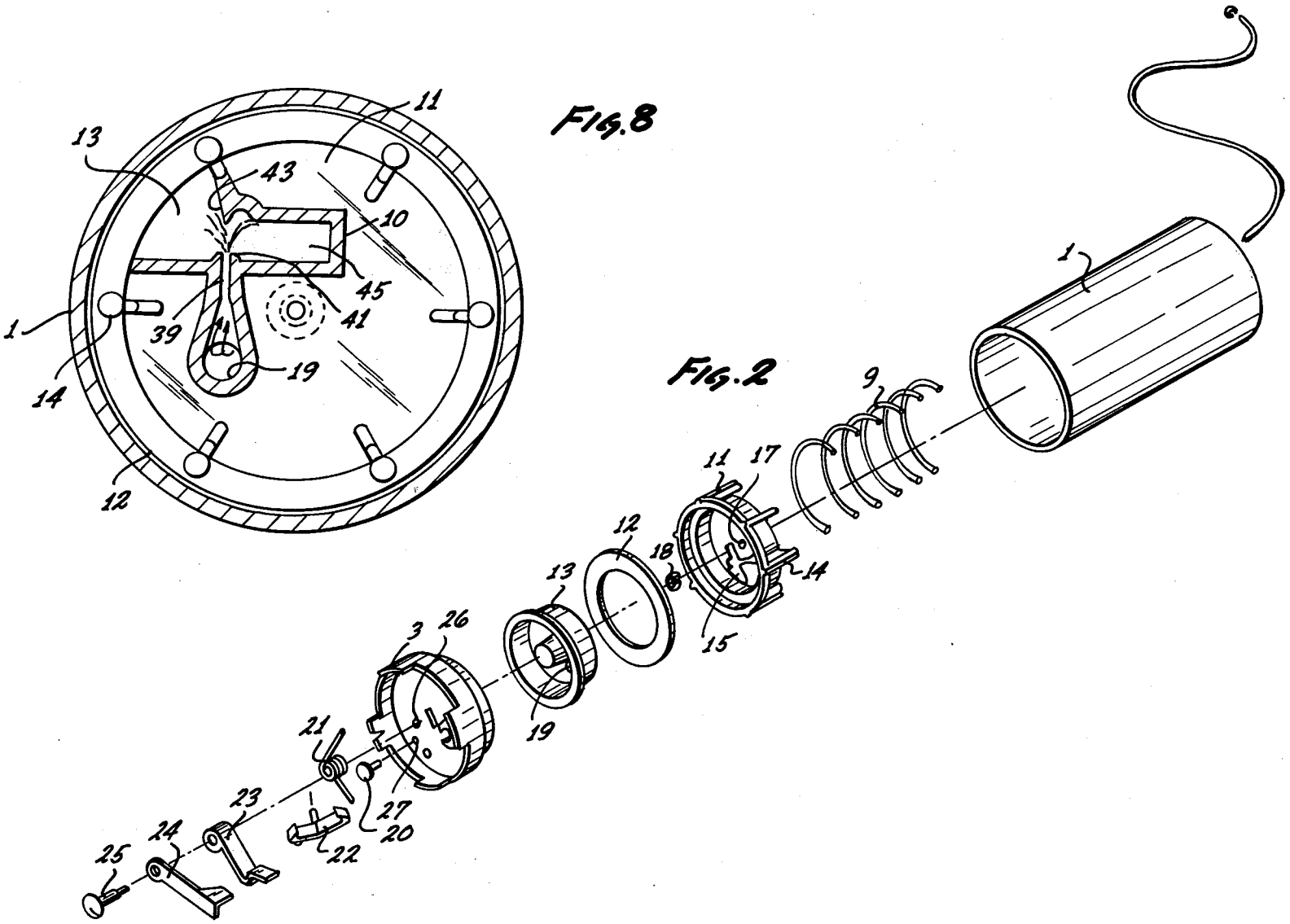
FIG. 2 is an exploded view of the embodiment of FIG. 1.
FIG. 8 is a cross-section taken along the lines 4—4 in FIG. 3.

To initially acquaint the reader in greater detail with the structural elements contained within the cylinder, end wall member 3 is removed, the cylinder is reversed from the position of FIG. 1, and the internal elements are shown in an exploded view in FIG. 2. As previously described, bead 6, which attaches to a cord 5, as previously described, and the elongated hollow cylinder 1 are shown. The elements include a helical compression spring 9, a first piston member 11, a washer shaped gasket 12 and a second piston member 13, which are attached together to form a piston assembly, as is later described. Gasket 12 is of a neoprene or equivalent material so as to be capable of forming an airtight seal. The piston member 11 includes a front rim, a series of axially rearwardly-extending ribs, such as rib 14, extending from the front rim with which to engage the surface of the wall to prevent the piston surface from binding in the cylinder and a recessed surface, and an inner annular rim between the bottom surface and the front rim. Additionally an edge tone sound generator, commonly known as a whistle, is formed at 15 by passages between the front of the recessed surface and the back of the member as is described in greater detail in this specification. A second small cylindrical passage 17 is provided for the end of cord 5 which may either be knotted or attached by means of a clip or bead 18 to attach to the piston member. The second piston member 13 is of a cuplike geometry having an axially extending cylindrical portion which fits through rubber gasket 12 and seats in a friction fit within the well in piston member 11. Member 13 includes an annular rim forming an outwardly protruding lip. A portion 16 protrudes from the bottom of member 13. A small orifice 19 extends through piston member 13 which opens onto sound generator 15 in the first piston member. Base member 3 which seats within one end of cylinder 1, as depicted in FIG. 1, is of a cylindrical geometry having a reduced diameter cylindrical portion which fits within cylinder 1 and a recessed front circular surface bordered by a rim. Member 3 supports the remaining elements which form part of a paper cap detonating assembly. The cap detonating assembly includes a latch pin 20, a torsion spring 21, a latch 22, a hammer 23, a detonating cap retainer 24 and a shoulder rivet 25. An anvil surface 28 is formed within member 3. As is represented, the end of the shoulder rivet includes a reduced diameter portion which seats within an opening 26 in base member 3 and extends through cylindrical openings in the cap retainer, the hammer 23, the hammer spring 21. Latch pin 20 slidably seats in an opening 27 in member 3. The opening extends through to the back side of base 3 as is later more fully described.

Figure 3:
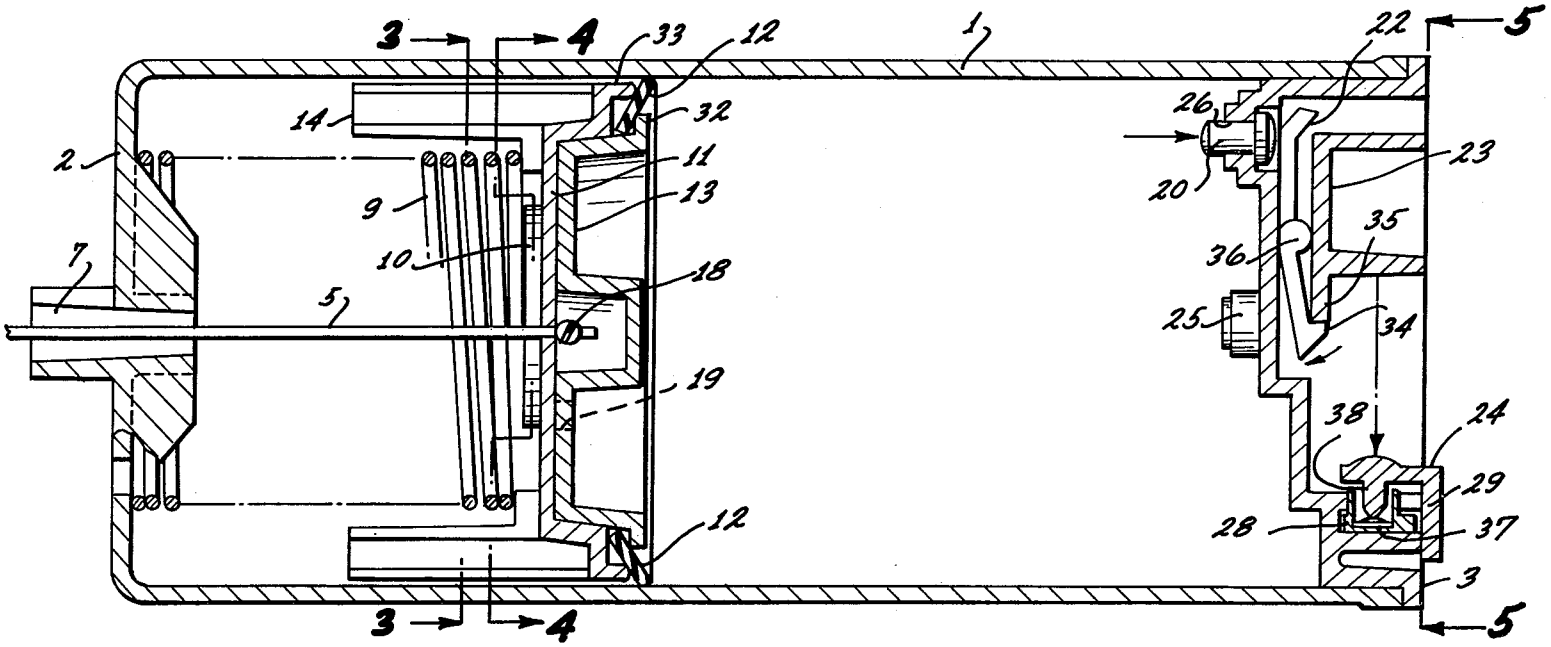
FIG. 3 is a cross-section to enlarged scale of the embodiment of FIG. 1 taken along the lines 1—1.

Reference is now made to FIG. 3, which illustrates to enlarged scale the section of FIG. 1 taken along the lines 1—1, to present in greater detail the relationship of the elements previously illustrated and described in FIG. 2. The reference numerals used in this figure to identify elements are the same as those used in connection with the identification and description of the same element in FIG. 2. As is shown in this section view, the cord 5 is illustrated as pulled taut to withdraw the piston assembly, consisting of piston members 11 and 13 and seal 12, to a rear position most proximate the end wall 2 and to compress spring 9. The cuplike piston member 13 is seated tightly within the well or recessed portion at the front surface of piston member 11 and gasket 12 is compressively held between the radially outwardly-extending rim 32 of piston member 13, which presses upon the front side of the washer, and an axially extending rim 33 of piston member 11, which presses on the back side of the washer. This forces the neoprene washer to assume a frusto-conical geometry in this position. The gasket serves to provide an airtight seal between the piston assembly and the inner walls of cylinder 1 when the piston assembly moves to the right axially through cylinder 1, which could not be otherwise obtained with the plastic materials due to the inability to maintain tolerances and to account for wear. The seal also allows air to enter the region in front of the piston assembly from the cylinder region behind the piston assembly as the piston assembly is being retracted to the positions shown. In the retracted position a predetermined volume extending over a predetermined axial distance of cylinder 1 between member 13 and base 3 is provided as a pneumatic tube, which becomes more apparent hereinafter in this description. The axially rearwardly extending ribs 14 attached to piston member 11 clearly serve to prevent the piston assembly from cocking or jamming in cylinder 1 and ensure axial movement. Additionally, piston member 13 includes a passage 19, illustrated in dash lines, providing an inlet into a cavity, generally indicated at 10, formed in piston member 11 containing an air whistle, more fully described hereinafter in connection with FIGS. 7 and 8.

The base member 3 of the cap-detonating assembly is sealed to the end of the cylinder 1 in an essentially airtight fit, leaving at most only slight air passages, such as might exist due to any slight clearances between latch pin 20 and the walls of opening 26 in which the latch pin is slidably disposed. These slight air passages should be generally insufficient to detract from the buildup of pressure in the operation of the device as later described.

As is apparent from this view of latch 22, the latch includes two extended strip portions which are formed together at an angle at a pivot point 36. One end of latch 22 contains a hooklike end 34 with a flat surface that engages a lip or edge 35 of hammer 23, shown in cocked position. The latch arrangement resembles a rocker arm. Hence, by applying an axially directed force on pin 20, pin 20 slides forward rocking one arm of the latch axially forward, and causes the hook end 34 to rotate clockwise about pivot point 36, withdrawing the hook end from engagement with element 35 of hammer 23. Released, hammer 23 is driven by the torsion spring, not illustrated in this figure, in the direction of the arrow. Base 3 includes the anvil member 28 for receiving a paper cap 37. The cap retainer 24 illustrated in this figure, contains a pointed member 38 overlying and pressing against the cap, the rear side of which is located in the path of travel of hammer 23 as represented by the arrow. Cap retainer 24 contains a downwardly depending portion 29 which forms a cover or barrier, known as a flash protector, to the side of anvil 28. The construction and mode of operation of the cap firing mechanism in this embodiment is more clearly understood by considering the aforedescribed structure further in the other views presented in FIGS. 4, 5 and 6 in which identical elements are identically numbered. In FIG. 4, an end view taken along 5—5 of FIG. 3, the hammer 23, the cap retainer 24, the hammer spring 21, and the shoulder pin 25 are shown assembled together within the well formed in the base member 3. Hammer 23 and cap retainer 25 are mounted rotatably to and held in place by shoulder pin 25. The hammer includes a flat hammerlike surface and a framelike assembly is formed integral therewith to make the assembly more rigid. The depending flash protector 29 portion of cap retainer 24 is cut-away in this view and represented only in outline by the dash lines to allow a clear view of the anvil assembly 28, the cap 37 and the protruding portion 35 of retainer 24. Latch 22 is shown underlying hammer 23 and the hook end thereof, 34, is engaging the depending extension 35 of hammer 23. Underlying the other end of the latch, as indicated by the dash lines, is latch pin 20 previously referenced in FIG. 3.

As is shown in this view, when the hammer 23 is released it is driven by torsion spring 21, which grasps the extending arm of the hammer with considerable force, in a path transverse the axis of the cylinder 1 to the position indicated by the dash lines 23' in abutment with the end of cap-retaining member 24 so as to drive the pointed end 38 compressively into the inserted cap 37.

FIG. 5 is a partial section view taken along the lines 6—6 on FIG. 4, in which hammer 23 is considered in the final position after firing, as represented by the dash line 23' in FIG. 4. This shows more clearly the structure and relationship of torsion spring 21, a portion of the cap-retaining arm 24 and the hammer 23. FIG. 6 illustrates a partial section view taken along the line 7—7 of FIG. 4 in the latter of which the hammer 23 is considered in its final position, represented by the dash line 23', and illustrates the piston assembly consisting of members 11, 12 and 13 in the fully extended position in which the rim 32 of piston member 13 abuts the underside of the latch pin 20 and has moved the latch pin axially forward to rock latch 22 about its pivot point 36 so that the hook end 34 thereof is rotated down out of the way and hammer 23 is shown in the final position abutting the firing end of arm 24', such as was indicated by the dash lines 23' in FIG. 4.

It is believed that the foregoing description and illustration of the cap-detonating portion of the simulated firecracker is adequate to ensure a complete understanding of its construction.

Reference is now made to FIGS. 7 and 8. FIG. 7 is a cross-section of the FIG. 3 taken along the lines 3—3 to illustrate the rear perspective view of the piston element 11 and FIG. 8 is a section view of FIG. 3 taken along the lines 4—4 to illustrate a further section of the same piston element 11 and provide a more clear and detailed illustration of the air whistle or resonator coupled edge tone sound generator, as variously termed, incorporated within the piston assembly. As is shown in FIG. 7, a protruding portion of a peculiar geometric shape 10 is formed in piston member 11 during the injection molding process in which member 11 is formed. A passage or air outlet 8 from that cavity is provided to allow air to release to the rear of the piston member during operation.

The area illustrated by the dash lines, not visible in this section view, illustrates the configuration of the air whistle molded into the piston member and formed between the piston elements 11 and 13, more particularly and better illustrated in FIG. 8. The section taken along the lines 4—4 in FIG. 3 cuts through the protruding member 10 to reveal the area illustrated in hidden lines in the preceding FIG. 7. As is apparent from this view, the flat rear surface of the piston member 13 is backed up against the flat front surface of piston member 11 to form suitable walls. The orifice 19, previously noted in connection with the exploded view of FIG. 2 and in FIG. 3, overlies the passage and provides an air inlet from the cylinder region in front of the piston assembly into the region formed by the wall of 13 and the cutaway wall portion 10. This includes an area where the air may be formed into a stream feeding into a square-shaped cross-section jetstream 39 and exiting out a nozzle 41 where air at high velocity is propelled against a chisel-shaped edge 43 to generate a sound or whistle. Adjoining this sound-generating means is a rectangular-shaped audio frequency resonator cavity 45 which enhances or acoustically amplifies sound. As previously described in connection with preceding FIG. 7, the expended air is expelled through passage 8 to the rear of the piston.

Preferably the walls of the resonator portion should be massive and as stiff as possible to produce the best possible resonance effect. The construction joints should be well sealed and any leak between the nozzle and the resonator will adversely affect performance. The nozzle 41 is seen to protrude into the resonator area. That contour reduces the acoustic boundary layer thickness at the nozzle and provides a more effective feedback signal. Second, fine tuning of the nozzle to edge distance is possible by removing material from the protruding surface. This eliminates the need to rework the edge to change the edge distance.

By way of specific example, the edge 43 should be as sharp as possible, although a 0.005-inch roundness is believed to be permissible. The angle formed by the apex of edge 43, as shown, is preferably 30 degrees. The width of the jet area 39 is approximately 0.038 to 0.042-inch. Its depth considered perpendicular to the plane of the drawing is similarly approximately 0.038 to 0.042-inch, although this geometry is not critical but is preferably square in shape. The width of the resonator is approximately 0.180 to 0.220-inch and its depth at least to one wall is approximately one and one-half times the value chosen for the width of 39, namely 0.038 to 0.042-inch. The distance between the edge end of nozzle 41 and the apex of edge 43 is approximately 0.135 to 0.145-inch. The length of the jet area 39 is approximately $3 \times 0.038$ to $3 \times 0.042$-inch selected and the distance between the beginning of air jet formation area and the center of the inlet 19 is approximately ten times the width of the jet area or 0.38 to 0.42-inch. In that specific example, the piston displacement is considered to cover a length of approximately 4 inches with the piston being of a 2 inch diameter. Further, the signal duration is approximately 3 seconds and the spring force necessary to power the whistle does not exceed 7 pounds. The sound emitted is in the audio range so as to produce a noticeable whistle. It is, of course, understood that although the foregoing embodiment describes a specific example of a sound generator and in particular of a specific type of whistle, it is obvious to one skilled in the art that other types of whistles of different specific configurations can be substituted if it is effective in such a combination of the invention. Inasmuch as the element is formed in the piston it is also clear that the whistle can be considered coupled to or actuated by the piston, or carried by the piston assembly in a generic sense.

An explanation of the operation or use of the invention in the combination is preferably commenced with illustrations of FIG. 1 and FIG. 3. Initially the user pulls back on the cord 5 to withdraw the piston assembly consisting of elements 11, 12 and 13, back and compress the spring 9. The cord is then hooked into the V-shaped notch of holder 7 seen in FIG. 1 and 3 to retain the cord against the pull of the compressed spring. With that preparation accomplished the user may cock the hammer 23 by taking it from a down position as shown in FIG. 6 and rotating it, against the force of torsion spring 21, up to the position shown in FIG. 3 where it is engaged by the hook end 34 of latch 22 and held against the force of the torsion spring 21 in FIG. 3. The user then lifts cap retainer 24 slightly and inserts a cap 37, such as the cap of the type manufactured by the Edison Company, onto the anvil, and then lowers retainer 34 so that the head 38 rests against the cap, firmly holding the cap in place in the anvil.

The user then removes the cord from the V-shaped notch and releases it to permit the spring 9 to force the piston assembly forward. Initially the air pressure in the chamber formed between the front of element 13 of the piston assembly and the rear of base 3 is at atmospheric pressure. However, when the piston suddenly moves forward under the force of the spring a short distance, the pressure in the chamber rapidly builds up to a high level, producing a significant pressure differential between the front and rear of the piston assembly. As was noted earlier, the piston assembly and base 3 provides an essentially airtight seal and the cylinder 1 section functions as a pneumatic tube. Air passes through inlet passage 19 in member 13 and through air whistle assembly 10 previously described in detail in connection with FIG. 7 and 8, creating a whistling noise as the piston assembly moves slowly axially forward, and the air passes outlet 8 to the rear side of the piston assembly at atmospheric pressure. This whistle-like sound persists as the piston under the force of the spring maintains a pressure differential and moves axially along cylinder 1 toward the base 3. Suitably, the sound is generated for a period of three seconds. After the time delay subsequent to release of cord 5, the piston assembly reaches the end of its travel, and its rim 32 abuts against the latch pin 20 as indicated by the arrow. The force remaining in the spring 9 is sufficient to force the piston to axially move latch pin 20 to unlock latch 22. Latch 22 rocks about its pivot point 36 and disengages from the hammer 23 and hammer 23 is propelled under the force of torsion spring 21 into cap retainer 24. The striking force is sufficient to drive head 35 into cap 37 and detonate the cap. The final position is illustrated in FIG. 6 with the latch pin moved forward and the hammer 23 abutted against the head of element 24, whereby the spike 38 is driven into the cap 37 to cause the loud exploding sound. The disclosed device thus provides a means for simulating a firecracker acoustically or a mortar in which upon release of a cord or like member a whistling sound is created for a predetermined duration followed by a second explosion-like noise. More particularly, under control of a spring and piston assembly once initiated a whistling effect is first produced and thereupon after a time delay the trigger of a cap exploding mechanism is actuated. The child is thus provided a toy that does not possess the danger of an actual explosive such as the firecracker but which perhaps duplicates the thrill and excitement associated with those explosives without the incident danger.

It is believed that the foregoing description of a preferred embodiment of the invention is sufficient in detail to enable one skilled in the art to make and use same. However, it is expressly understood that the invention is not limited to the details presented for that purpose inasmuch as many variations in specific detail by way of alteration or modification or substitution of equivalent elements in the combination, all of which embody the invention, becomes apparent to those skilled in the art upon reading this specification. It is thus requested that the invention be broadly construed, both as to its broad aspects and as to the novel subcombinations, within the full spirit and scope of the appended claims.

What is claimed is:

1. A firecracker which comprises:

a cylindrical tube, said tube having a first wall closing one end and an aperture through said end wall;

a resiliant cord extending through said aperture into said tube;

piston means located within said tube in sealing engagement with the inner walls thereof and adapted to travel therethrough and pressurize a portion of said tube;

helical spring means connected in between said piston and said first end wall for driving said piston means;

means coupling said cord to said piston for permitting said cord to retract said piston to a loaded position and concurrently to compress said spring;

acoustic sound generating means coupled to said piston means for generating a whistle-like sound over a predetermined interval of time upon release of said cord;

a cap-detonating means, including a base;

a detonating cap-receiving anvil means;

hammer means adapted to pivot and strike said cap-receiving anvil means for exploding any cap placed thereon;

shoulder pin means mounted to said base for pivotally mounting said hammer means for pivotal movement transverse to the axis of said tube;

torsion spring means mounted on said shoulder pin means coupled to said hammer means for driving said hammer means;

latch means for holding said hammer means in a loaded position;

latch pin means for releasing said latch means in response to a force thereon;

said base being carried at the remaining end of said tube in sealing engagement therewith;

a passage through said base;

said latch pin means extending through said passage for slidable movement therein with an end of said pin located in the path of travel of said piston means, said compression spring means having sufficient force to push said piston means into engagement with and move said latch pin means, whereby upon release of said cord a whistle-like sound is emitted for a short interval of time followed by explosion of an installed cap.

2. The invention as defined in claim 1 further comprising: an apertured cylindrical member coupled to said first end wall coaxial with said aperture, said cord extending therethrough, and an axially extending V-shaped notch to hold said cord.

3. A simulated toy firecracker comprising:

an elongated cylindrical body simulating a firecracker body;

a small opening at one end thereof;

an elongated cord simulating a fuse extending from an end thereof;

cap-receiving and detonating means carried by said body;

sound-generating means located within said body;

energizing means responsive to the withdrawal and subsequent release of said cord for energizing said sound-generating means for a short interval of time and thereafter actuating said cap-receiving and detonating exploding means.

4. The invention as defined in claim 3 wherein said energizing means comprises:

piston means for axial movement in said tube;

compression spring means;

said cord being coupled to said piston means for retracting said piston and compressing said spring.

5. The invention as defined in claim 4 wherein said sound-generating means comprises:

means responsive to a predetermined pressure differential between the front and back side of said piston means for creating a stream of air between said front and back sides and means responsive to said stream of air for creating an audible whistle.

6. A toy comprising:

a pneumatic tube;

cap-detonating means coupled to said tube, said cap-detonating means for detonating a cap responsive to actuation of a trigger means;

piston means located in said tube, said piston means being axially movable through said tube;

compression spring means for driving said piston means;

cord means coupled to said piston means for withdrawing said piston to a first position and compressing said spring means;

said piston means including seal means for providing a seal between said piston means and the inner walls of said pneumatic tube;

said piston means further including air passage means for allowing restricted passage of air between the front and back sides of said piston means;

and means locating said trigger means at a predetermined position remote from said first position in the path of travel of said piston means;

whereby upon release of said cord means said piston is driven by said spring means and moves forward along said tube to pressurize said pneumatic tube, creating a pressure differential between the front and back side of the piston means, and whereby said piston means moves forward slowly as air passes through said air passage means over a period of time and is incident upon and actuates said trigger means.

7. The invention as defined in claim 5 wherein said air passage means comprises:

a resonator coupled edge tone sound generator responsive to a predetermined pressure difference between the front and back sides of said piston means for generating a whistle-like sound.

8. The invention as defined in claim 6 wherein said resonator coupled edge tone sound generator includes:

a first cavity communicating with an air inlet in the front side of said piston means;

a restricted passage communicating with said first cavity;

a nozzle outlet coupled to said restricted passage;

a protruding member having a triangular edge spaced from and facing said nozzle, adapted to receive air propelled out said nozzle;

and a rectangular cavity communicating with the space between said nozzle and said protruding member.

9. The invention as defined in claim 5 wherein said cap-detonating means comprises:

a base having a bottom surface mounted transverse the axis of said pneumatic tube;

hammer means mounted for pivotal movement on said base transverse the axis of said pneumatic tube;

anvil means contained on said base for receiving a detonating cap, said anvil means located in the path of travel of said hammer means;

torsion spring means for driving said hammer;

latch means for releasibly engaging said hammer means to hold said hammer means against the force of said torsion spring at a position remote from said anvil;

and wherein said trigger means comprises:

latch pin means extending through a passage in said base into the interior of said tubes, said latch pin means being slidably mounted in said base passage for movement parallel to the axis of said pneumatic tube;

said latch pin means responsive to a force for engaging and releasing said latch means.

10. The invention as defined in claim 5 further comprising:

catch means carried by said tube for holding said cord means.

11. The invention as defined in claim 8 wherein said cap-detonating means comprises further:

cap-retainer means pivotally mounted to said base for pivotal movement about the same pivot point as said hammer means;

said cap-retainer means having a protruding member for at one end engaging a cap installed in said anvil means and at the opposite end mounted in the path of travel of said hammer means adapted to be struck by said hammer means.

* * * * *